US011965327B2

(12) United States Patent
Zhang

(10) Patent No.: US 11,965,327 B2
(45) Date of Patent: Apr. 23, 2024

(54) PREFABRICATED MODULE

(71) Applicant: CHANGSHA BROAD HOMES INDUSTRIAL GROUP CO., LTD, Hunan (CN)

(72) Inventor: Jian Zhang, Hunan (CN)

(73) Assignee: Changsha Broad Homes Industrial Group Co., Ltd, Hunan (CN)

( * ) Notice: Subject to any disclaimer, the term of this patent is extended or adjusted under 35 U.S.C. 154(b) by 0 days.

(21) Appl. No.: 17/768,547

(22) PCT Filed: Oct. 23, 2019

(86) PCT No.: PCT/CN2019/112658
§ 371 (c)(1),
(2) Date: Apr. 13, 2022

(87) PCT Pub. No.: WO2021/077316
PCT Pub. Date: Apr. 29, 2021

(65) Prior Publication Data

US 2024/0011281 A1 Jan. 11, 2024

(30) Foreign Application Priority Data

Oct. 21, 2019 (CN) ..... 201910999617.1

(51) Int. Cl.
*E04H 1/00* (2006.01)
*E04B 1/348* (2006.01)
*E04C 2/288* (2006.01)

(52) U.S. Cl.
CPC ..... *E04B 1/34823* (2013.01); *E04C 2/2885* (2013.01)

(58) Field of Classification Search
CPC ..... E04B 1/34823; E04C 2/2885
See application file for complete search history.

(56) References Cited

U.S. PATENT DOCUMENTS 3,922,413 A * 11/1975 Reineman ..... B32B 3/26 52/576
4,069,629 A * 1/1978 Piazza ..... E04B 1/4121 52/309.4

(Continued)

FOREIGN PATENT DOCUMENTS

CN 1818274 A 8/2006
CN 101451385 A 6/2009

(Continued)

OTHER PUBLICATIONS

English language abstract for CN 1818274 A (2006).

(Continued)

*Primary Examiner* — Basil S Katcheves
(74) *Attorney, Agent, or Firm* — Caesar Rivise, PC

(57) ABSTRACT

The present invention discloses a prefabricated module, including a bottom plate, a left side plate, a top plate, and a right side plate. The bottom plate, the left side plate, the top plate, and the right side plate are connected in sequence to form a closed loop. Filling internal molds are provided inside the bottom plate, the left side plate, the top plate and the right side plate. The filling internal molds are provided with a plurality of through holes. Tensile members are further provided inside the prefabricated module, the tensile members are continuously distributed inside the bottom plate, the left side plate, the top plate and the right side plate, and the tensile members are connected end to end. The filling internal molds and the tensile members are encapsulated inside an inorganic composite material. The structure of the prefabricated module can improve the strength and reduce the weight.

8 Claims, 4 Drawing Sheets

(56) References Cited

U.S. PATENT DOCUMENTS

| | | | | | |
|---|---|---|---|---|---|
| 4,084,362 | A * | 4/1978 | Piazza | E04B 1/4121 52/705 |
| 4,229,497 | A * | 10/1980 | Piazza | B32B 13/12 264/257 |
| 4,232,494 | A * | 11/1980 | Bauch | E04B 1/32 428/920 |
| 4,548,007 | A * | 10/1985 | Newman | E04C 2/40 264/261 |
| 4,945,694 | A * | 8/1990 | Mitchell | E04C 2/2885 52/223.1 |
| 2020/0392731 | A1* | 12/2020 | Sloane | E04C 2/46 |
| 2021/0323879 | A1* | 10/2021 | Luo | C04B 28/065 |

FOREIGN PATENT DOCUMENTS

| | | | |
|---|---|---|---|
| CN | 106760143 | A | 5/2017 |
| CN | 109079962 | A | 12/2018 |
| CN | 110685351 | A | 1/2020 |
| DE | 102012110159 | A1 | 4/2014 |

OTHER PUBLICATIONS

English language abstract for CN 101451385 A (2009).
English language abstract for CN 106760143 A (2017).
English language abstract for CN 109079962 A (2018).
English language abstract for CN 110685351 A (2020).
English language abstract for EP 2724832 A2 (2014).
International Search Report from corresponding PCT/CN2019/112658 mailed Jun. 30, 2020.

* cited by examiner

PREFABRICATED MODULE

CROSS-REFERENCE TO RELATED APPLICATIONS

This application is a U.S. National Phase Application of PCT/CN2019/112658, filed Oct. 23, 2019, which claims priority to CN 201910999617.1, filed Oct. 21, 2019, the contents of which applications are incorporated herein by reference in their entireties for all purposes.

FIELD OF THE INVENTION

The present invention relates to a prefabricated module, and belongs to the technical field of buildings.

BACKGROUND OF THE INVENTION

Buildings assembled from prefabricated components on site are called prefabricated buildings. A large number of building components in prefabricated buildings are produced and processed in factories. The main types of prefabricated components are: prefabricated wall panels, laminated panels, prefabricated stairs, prefabricated beams, prefabricated columns, etc. Compared with traditional cast-in-place buildings, the prefabricated buildings assembled with a variety of prefabricated components reduce the use of construction formworks, shorten the construction period, reduce labor intensity, are conducive to environmental protection, and improve the level of industrialization in the construction industry. However, due to factors such as many types of components and huge differences in size and specifications, it is difficult for the industrialization level of prefabricated buildings to reach a high level, and the production efficiency still needs to be improved. The inventor's previous patent application (publication number: CN208981519U) proposes a building structure module, which is equivalent to the smallest prefabricated structural unit of a building. Compared with existing prefabricated buildings, the structure module has higher degree of integration, breaks the limitation of the transportation size on the use space of a house, enables the house to be relatively wide and deep, can meet the requirements of most house construction, and has an excellent industrialization prospect. However, how to reduce the overall weight and improve the thermal insulation performance while ensuring the structural strength has become a technical problem that needs to be solved urgently.

SUMMARY OF THE INVENTION

In order to improve the structural strength of a prefabricated module and reduce the weight of the prefabricated module, the present invention provides a prefabricated module, and the specific technical solution is as follows.

A prefabricated module, including a bottom plate, a left side plate, a top plate and a right side plate, the bottom plate, the left side plate, the top plate and the right side plate are connected in sequence to form a closed loop; wherein filling internal molds are provided inside the bottom plate, the left side plate, the top plate and the right side plate; the filling internal molds are provided with a plurality of through holes, and the through holes are perpendicular to the corresponding bottom plate, left side plate, top plate or right side plate; tensile members are further provided inside the prefabricated module, the tensile members are continuously distributed inside the bottom plate, the left side plate, the top plate and the right side plate, and the tensile members are connected end to end; and the filling internal molds and the tensile members are encapsulated inside an inorganic composite material.

With the above technical solution, the filling internal molds play a role of internal molds and achieve a filling effect, and the internal molds can define the internal structure and form of the prefabricated module; by casting the inorganic composite material, the filling internal molds and the tensile members are encapsulated inside the inorganic composite material, and the inorganic composite material is distributed on both sides of the filling internal molds and in the through holes of the filling internal molds, the continuously distributed tensile members can ensure that the structural strength of the prefabricated module meets the set design requirements.

Further, the tensile members are steel bars or fiber reinforced bars or steel wire ropes.

Further, the direction parallel to the bottom plate, the left side plate, the top plate and the right side plate at the same time is a depth direction, a plurality of filling internal molds are arranged at intervals along the depth direction, and the tensile members are distributed in gaps between two adjacent filling internal molds. This arrangement can ensure the integrity of the inorganic composite material on both sides of the filling internal molds and the inorganic composite material between two adjacent filling internal molds, and appropriately reduces the thicknesses of the bottom plate, the left side plate, the top plate and the right side plate on the basis of ensuring the overall structural strength and thermal insulation performance of the prefabricated module.

Further, the direction parallel to the bottom plate, the left side plate, the top plate and the right side plate at the same time is a depth direction, the filling internal molds are provided with grooves, the grooves extend in a direction perpendicular to the depth direction, the grooves of the filling internal molds inside the bottom plate, the left side plate, the top plate and the right side plate are communicated with each other, and the tensile members are located in the grooves. The grooves mark the positions of the tensile members to appropriately reduce the thicknesses of the bottom plate, the left side plate, the top plate and the right side plate, and the grooves can be filled with the inorganic composite material to improve the overall structural strength of the prefabricated module.

Further, the bottom of the groove is also provided with the through holes. This improves the encapsulation property of the tensile members, and is beneficial to the uniform distribution of the inorganic composite material.

Further, the inorganic composite material is concrete or high-strength concrete or ultra-high-performance concrete.

Further, the prefabricated module further includes locating members, the locating members are used for fixing the tensile members, and the locating members are vertically and fixedly connected to the tensile members. Preferably, the locating members are steel bars or fiber reinforced bars or steel wire ropes.

The prefabricated module of the present invention uses the filling internal molds and the tensile members, which improve the distribution of the inorganic composite material, improve the overall structural strength of the prefabricated module, are beneficial to reducing the weight of the prefabricated module, can effectively improve the thermal insulation performance of the prefabricated module, and help to control the thickness of the prefabricated module, thereby providing a better solution for the industrial production and application of the prefabricated module.

Figure 1:
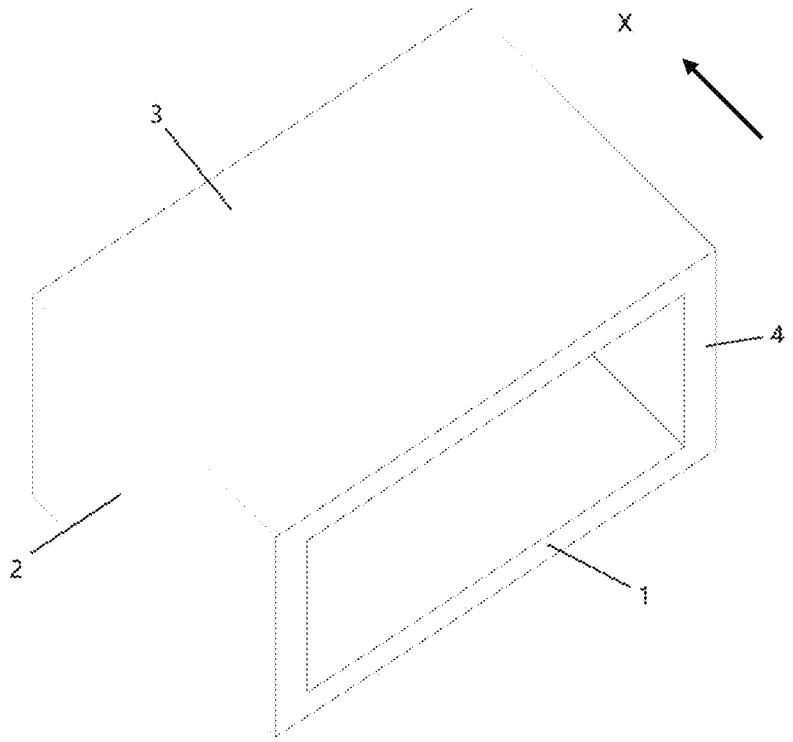
FIG. 1 is a schematic perspective view of a prefabricated module according to Embodiment 1 of the present invention.
Figure 2:
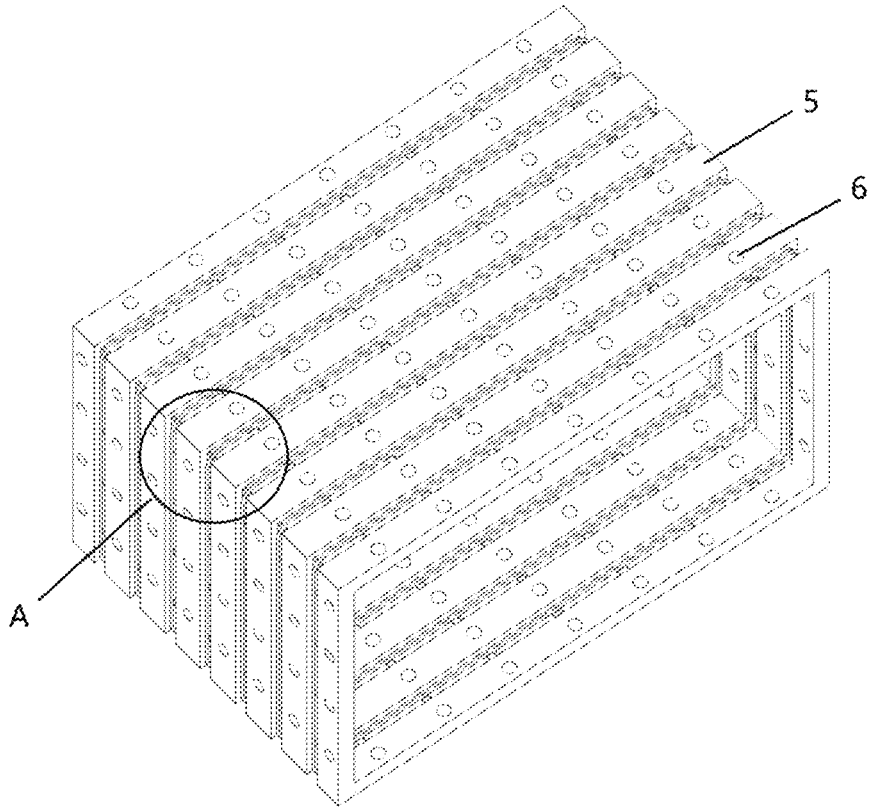
FIG. 2 is a schematic diagram of the prefabricated module in FIG. 1 without an inorganic composite material.
Figure 3:
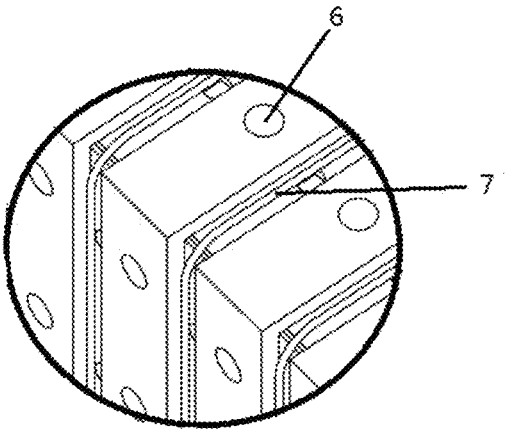
FIG. 3 is a schematic enlarged view of region A in FIG. 2.
Figure 4:
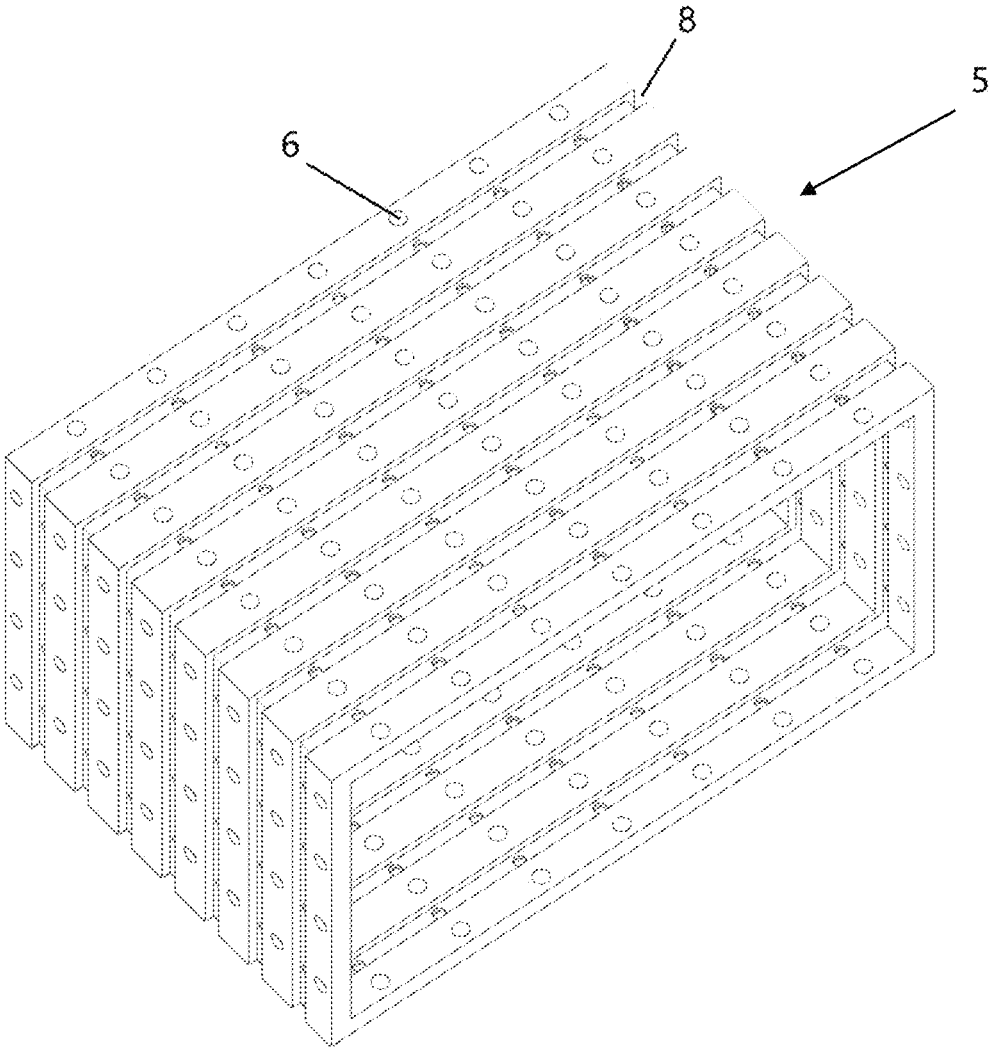
FIG. 4 is a schematic diagram of filling internal molds of the prefabricated module in an embodiment.

In the figures: depth direction X, bottom plate 1, left side plate 2, top plate 3, right side plate 4, filling internal mold 5, through hole 6, tensile member 7, groove 8, inorganic composite material 9.

DETAILED DESCRIPTION OF THE EMBODIMENTS

The present invention will be further described in detail below with reference to the accompanying drawings.

Embodiment 1

With reference to FIGS. 1-4, a prefabricated module includes a bottom plate 1, a left side plate 2, a top plate 3 and a right side plate 4, and the bottom plate 1, the left side plate 2, the top plate 3 and the right side plate 4 are connected in sequence to form a closed loop; filling internal molds 5 are provided inside the bottom plate 1, the left side plate 2, the top plate 3 and the right side plate 4; the filling internal molds 5 are provided with a plurality of through holes 6, and the through holes 6 are perpendicular to the corresponding bottom plate, left side plate, top plate or right side plate; the direction parallel to the bottom plate, the left side plate, the top plate and the right side plate at the same time is a depth direction X; the filling internal molds 5 are provided with grooves 8, the grooves 8 extend in a direction perpendicular to the depth direction X, the grooves 8 of the filling internal molds 5 inside the bottom plate, the left side plate, the top plate and the right side plate are communicated with each other, and the grooves 8 may be located in the outer surfaces and/or inner surfaces of the filling internal molds 5; tensile members 7 are further provided inside the prefabricated module, the tensile members 7 are located in the grooves 8, the tensile members 7 are continuously distributed inside the bottom plate 1, the left side plate 2, the top plate 3 and the right side plate 4, and the tensile members 7 are connected end to end; the filling internal molds 5 and the tensile members 7 are encapsulated inside an inorganic composite material 9, and the thermal conductivity of the filling internal molds 5 is less than that of the inorganic composite material 9.

The tensile members 7 are steel bars or fiber reinforced bars or steel wire ropes or other structures to bind the bottom plate 1, the left side plate 2, the top plate 3 and the right side plate 4 together, so as to ensure the overall structural strength of the prefabricated module.

The grooves 8 mark the positions of the tensile members 7 to appropriately reduce the thicknesses of the bottom plate, the left side plate, the top plate and the right side plate, and the grooves 8 can be filled with the inorganic composite material to improve the overall structural strength of the prefabricated module.

The filling internal molds 5 may be made of a light foam material, which reduces the overall weight of the prefabricated module, improves the thermal insulation performance of the prefabricated module, and is beneficial to energy conservation and emission reduction.

Preferably, the bottom of the groove 8 is also provided with through holes 6. This improves the encapsulation property of the tensile members, and is beneficial to the uniform distribution of the inorganic composite material.

The inorganic composite material may be concrete or high-strength concrete or ultra-high-performance concrete, or other high-performance materials that can be used for casting.

Preferably, the prefabricated module further includes locating members (not shown), the locating members are used for fixing the tensile members 7, and the locating members are vertically and fixedly connected to the tensile members 7. Preferably, the locating members are steel bars or fiber reinforced bars or steel wire ropes. After the tensile members are located and fixed by a plurality of locating members, the positions of all the tensile members 7 can be fixed during the production of the prefabricated module.

Embodiment 2

Figure 5:
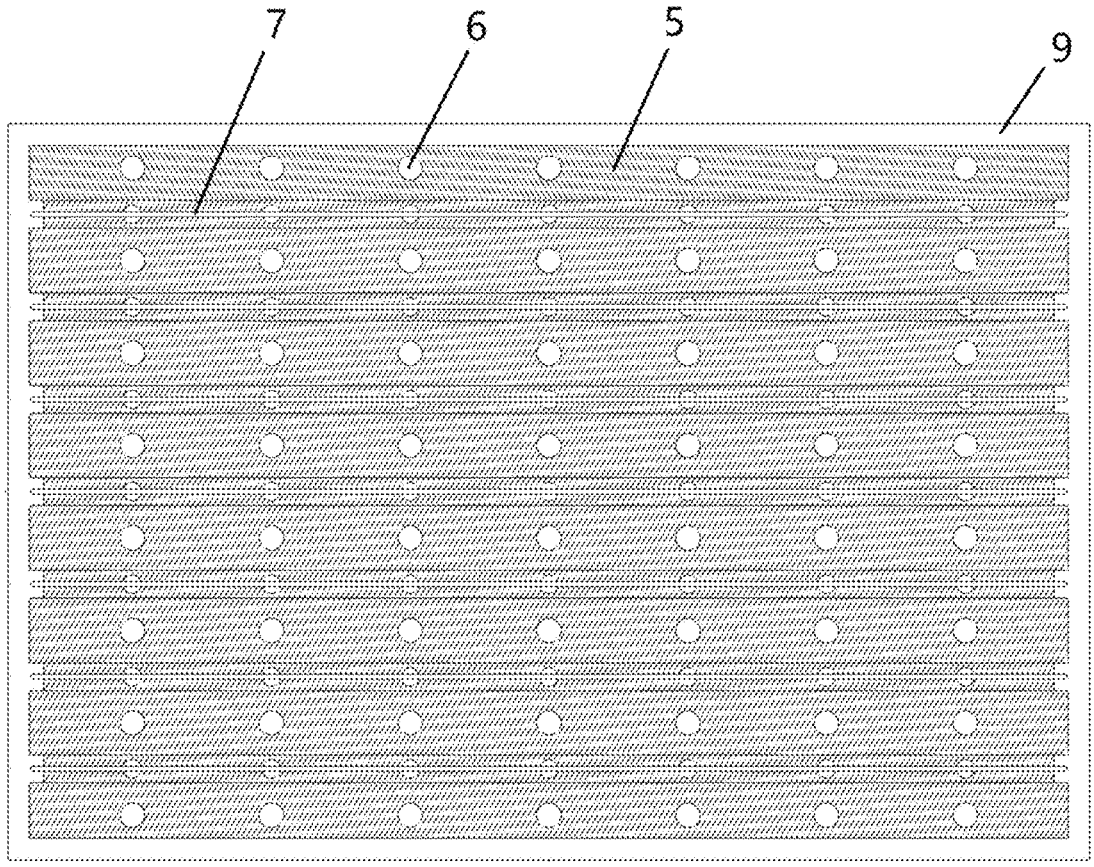
FIG. 5 is a schematic top view of the prefabricated module of Embodiment 1 (transparency of the inorganic composite material)
Figure 6:
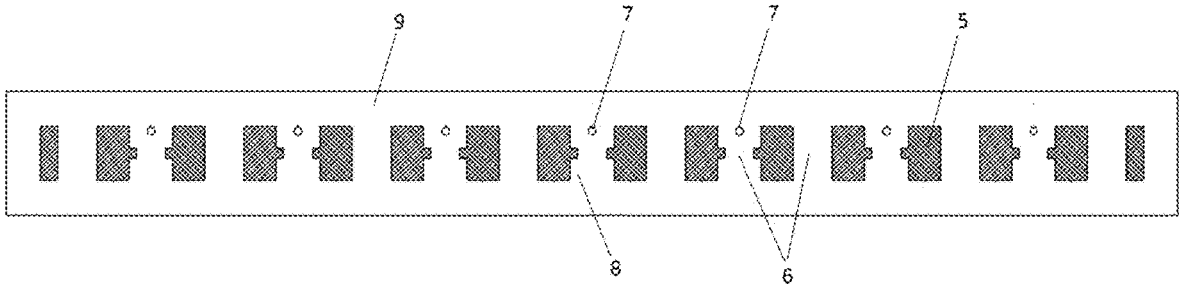
FIG. 6 is a schematic cross-sectional view of the prefabricated module of Embodiment 1 perpendicular to tensile members.
Figure 7:
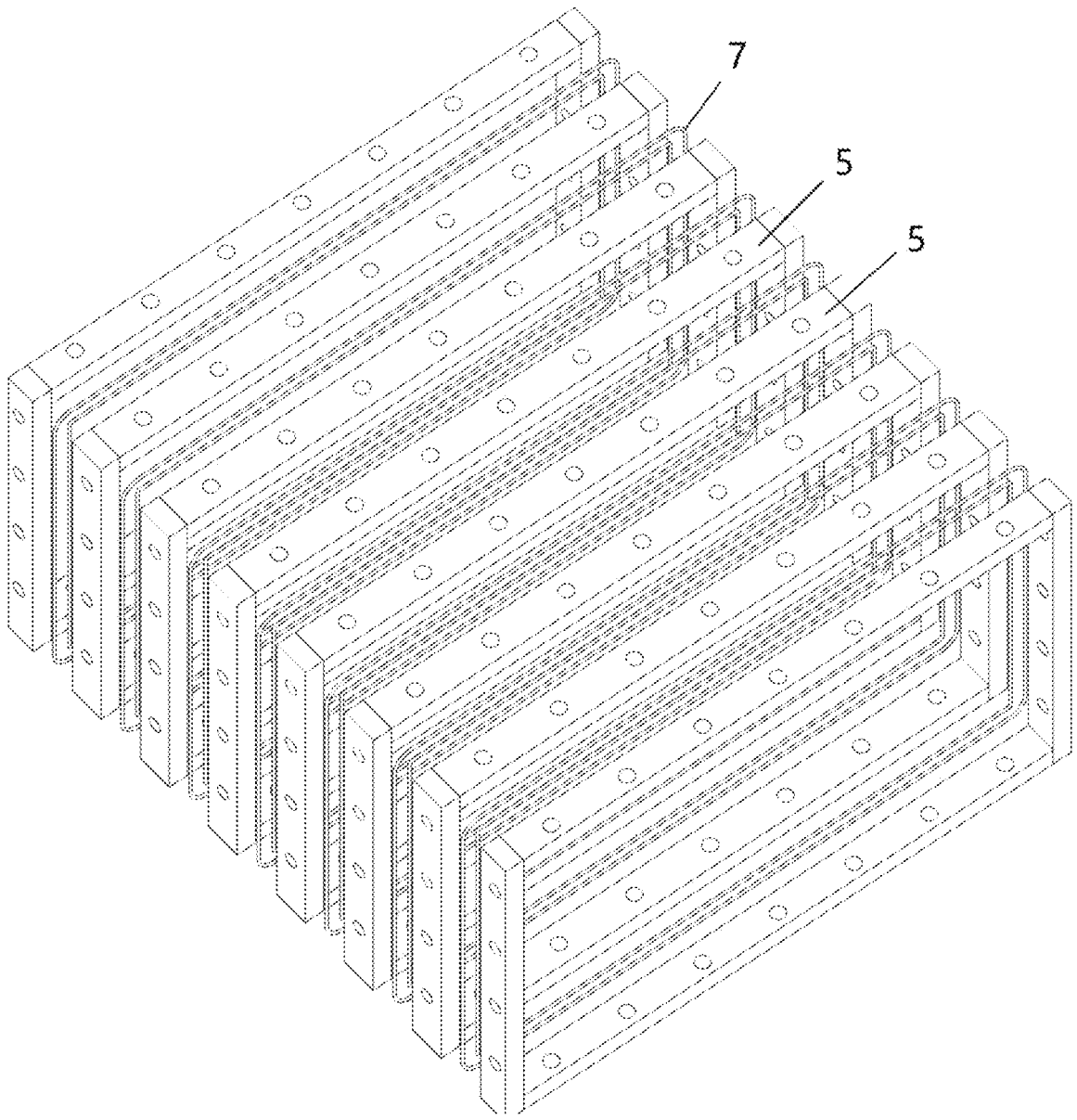
FIG. 7 is a schematic diagram of a prefabricated module of Embodiment 2 (without an inorganic composite material).

As shown in FIG. 5, the difference from Embodiment 1 is that a plurality of filling internal molds 5 are provided at intervals alongin the depth direction X, and the tensile members 7 are distributed in gaps between two adjacent internal molds. This arrangement can ensure the integrity of the inorganic composite material on both sides of the filling internal molds and the inorganic composite material between two adjacent filling internal molds, and appropriately reduces the thicknesses of the bottom plate, the left side plate, the top plate and the right side plate on the basis of ensuring the overall structural strength and thermal insulation performance of the prefabricated module.

The production method of the present invention greatly improves the production efficiency and integrity of the prefabricated module. The prefabricated module of the present invention is at least equivalent to the integration of two floors and two wall panels in a traditional prefabricated building, which is beneficial to improving the integration and industrialization level of prefabricated buildings.

The embodiments of the present invention are described above with reference to the accompanying drawings, and the embodiments of the present invention and the features of the embodiments may be combined with each other without conflicts. The present invention is not limited to the above-mentioned specific embodiments, and the above-mentioned specific embodiments are merely illustrative but not restrictive. Many forms may also be made by those of ordinary skill in the art under the enlightenment of the present invention without departing from the purpose of the present invention and the scope of the claims, and these forms fall into the scope of the present invention.

The invention claimed is:

1. A prefabricated module, comprising a bottom plate, a left side plate, a top plate and a right side plate, the bottom plate, the left side plate, the top plate and the right side plate are connected in sequence to form a closed loop; wherein filling internal molds are provided inside the bottom plate, the left side plate, the top plate and the right side plate; the filling internal molds are provided with a plurality of through holes, and the through holes are perpendicular to their corresponding bottom plate, left side plate, top plate or right side plate; tensile members are further provided inside the prefabricated module, the tensile members are continuously distributed inside the bottom plate, the left side plate, the top plate and the right side plate, and the tensile members are connected end to end; and the filling internal molds and the tensile members are encapsulated inside an inorganic composite material.

2. The prefabricated module according to claim 1, wherein the tensile members are steel bars or fiber reinforced bars or steel wire ropes.

3. The prefabricated module according to claim 1, wherein a direction parallel to the bottom plate, the left side plate, the top plate and the right side plate at a same time is a depth direction, a plurality of filling internal molds are arranged at intervals along the depth direction, and the tensile members are distributed in gaps between two adjacent filling internal molds.

4. The prefabricated module according to claim 1, wherein the direction parallel to the bottom plate, the left side plate, the top plate and the right side plate at the same time is a depth direction, the filling internal molds are provided with grooves, the grooves extend in a direction perpendicular to the depth direction, the grooves of the filling internal molds inside the bottom plate, the left side plate, the top plate and the right side plate are communicated with each other, and the tensile members are located in the grooves.

5. The prefabricated module according to claim 4, wherein the bottom of the grooves are provided with second through holes.

6. The prefabricated module according to claim 1, wherein the inorganic composite material is concrete or high-strength concrete or ultra-high-performance concrete.

7. The prefabricated module according to claim 1, wherein the prefabricated module further comprises locating members, the locating members are used for fixing the tensile members, and the locating members are vertically and fixedly connected to the tensile members.

8. The prefabricated module according to claim 7, wherein the locating members are steel bars or fiber reinforced bars or steel wire ropes.

* * * * *